United States Patent [19]

Schimanski

[11] 4,261,957

[45] Apr. 14, 1981

[54] HOLDER FOR TOILET DEODORANTS

[75] Inventor: Georg Schimanski, Breckerfeld, Fed. Rep. of Germany

[73] Assignee: Globol-Werk GmbH, Fed. Rep. of Germany

[21] Appl. No.: 14,305

[22] Filed: Feb. 23, 1979

[30] Foreign Application Priority Data

Sep. 13, 1978 [DE] Fed. Rep. of Germany ... 3 MR 1202
Nov. 18, 1978 [DE] Fed. Rep. of Germany ... 7834350[U]

[51] Int. Cl.[3] ..... F01C 1/00; F03C 2/00

[52] U.S. Cl. ..... 422/263; 422/266; 422/277; 4/228; 248/214; 248/205 R; 248/311.2

[58] Field of Search ..... 422/263, 266, 275, 276, 422/277; 210/249, 517, 514; 4/228, 222, 223, 227; 248/214, 205 R, 311.1 R

[56] References Cited

U.S. PATENT DOCUMENTS

| | | | |
|---|---|---|---|
| 2,880,077 | 3/1959 | Floria | 422/266 |
| 3,088,126 | 5/1963 | Klingler | 248/214 |
| 3,128,984 | 4/1964 | Palm | 248/214 |
| 3,423,182 | 1/1969 | Klasky | 422/263 |
| 3,538,920 | 11/1970 | Leavitt | 4/222 |
| 4,168,551 | 9/1979 | Hautmann et al. | 4/223 |

*Primary Examiner*—William F. Smith
*Assistant Examiner*—Chris Konkol
*Attorney, Agent, or Firm*—Jacobs & Jacobs

[57] ABSTRACT

Toilet deodorant holder comprising an elongated open basket to receive the deodorant or replacement deodorant having a plastic suspension bracket produced by integral deformation of the plastic with the basket and engaging over and beyond the mouth as the basket. The present arrangement makes it possible to simplify the production and use of the holder and to refill the basket automatically with deodorant as required.

18 Claims, 10 Drawing Figures

Fig. 1
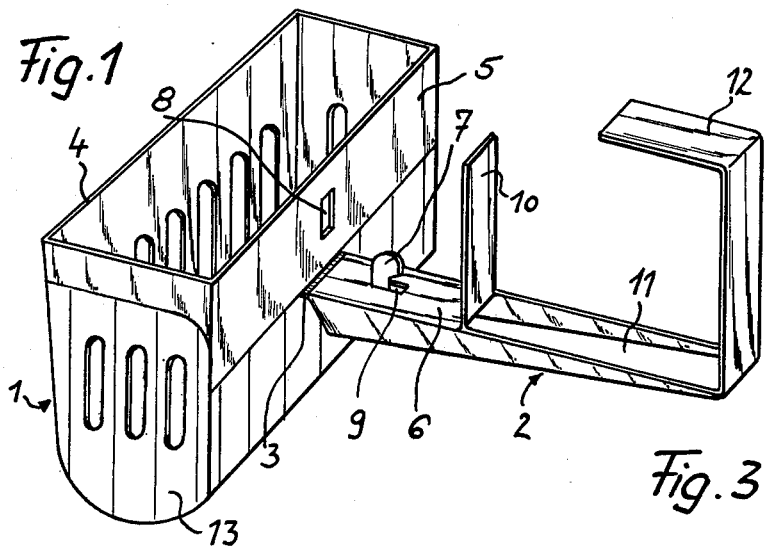
Fig. 3
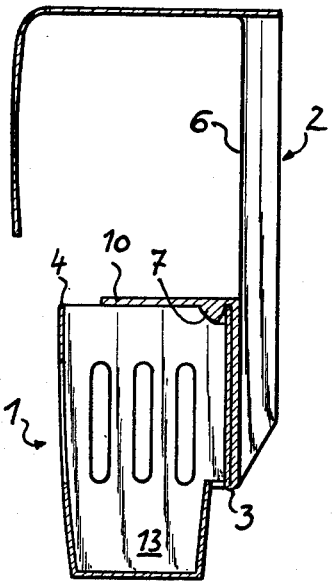
Fig. 2
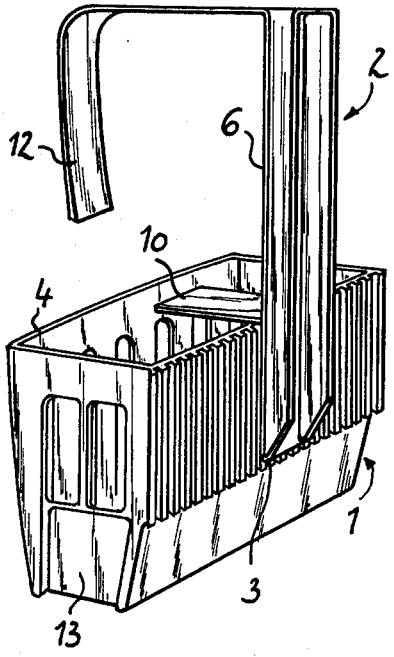
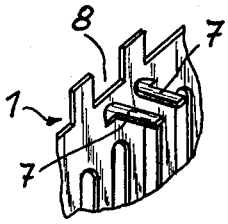
Fig. 4

HOLDER FOR TOILET DEODORANTS

The present invention relates to a holder for toilet deodorants which consists of an elongated open basket for the replaceable receiving of the deodorant and of a plastic suspension bracket which is produced by plastic deformation integral with the basket and engages over and beyond the mouth of the basket.

In one known holder of this type one arm of the approximately hook-shaped suspension bracket is produced attached, by means of a breakable connection, to the basket, in order to be able to produce basket and suspension bracket in one piece in a single operation by plastic shaping, for instance by injection molding.

For the use of the support, the suspension bracket must be broken off from the basket by the user and fastened vertically to the basket so as to be able to hang the basket in correct position on the edge of the toilet bowl.

For this purpose insertion openings are developed on the basket into which openings one arm of the suspension bracket is inserted, secured at least by friction.

These operations for the use of the holder which must be carried out by the user are, however, relatively complicated.

There is also the danger in this connection and, particularly after the attachment of the holder within the toilet bowl, that the deodorant present in the basket will, under the action of the flush water, slip out of the basket through its open mouth.

The object of the present invention therefore is to make it possible to simplify the steps required for the use of a holder of the above-mentioned type.

In this connection, however, there should also be the possibility of automatically filling the basket with deodorant.

Furthermore, the deodorant should be so located that it cannot be lost when the holder is in its position of use.

In addition, contact with the deodorant, particularly by the hands of children, should be prevented as the deodorant may contain poisons and/or corrosive substances.

In addition to this, it is desired to produce the holder with the use of very simple molds.

The attainment of these objects is characterized by the following features:

(a) one arm of the suspension bracket is permanently connected with the basket by means of a film hinge formed thereon, (b) the hinge axis extends parallel to the lengthwise direction of the basket, (c) the suspension bracket protrudes at a right angle from one long side of the basket and is developed so that it can be put in erect position in order to use the holder, and (d) detent means are provided in corresponding position on suspension bracket and basket in order to fix the suspension bracket removably in vertical position, (e) on the suspension bracket there is developed a bridge protruding at a right angle which when the suspension bracket is placed in upright position partially closes off the opening of the basket and prevents the deodorant present in the basket from sliding out of it.

In this way there is obtained a holder of the above-described type whose suspension bracket, in order to use the holder, need merely be swung out of the manufactured position into the position of use, in which position the suspension bracket is automatically held.

At the same time the deodorant contained in the basket is thereby secured against falling out and contact with the deodorant is at least made difficult.

Furthermore the manufacture of the entire holder is possible in a simple two-part mold, without requiring mold cores, thus assuring a low cost of manufacture.

Furthermore, the mouth of the basket is freely accessible for automatically filling the basket, the suspension bracket being in the manufacture position.

The deodorant can also be replaced or renewed just as conveniently without coming into direct contact with the deodorant.

A particularly stable position of use is obtained if the suspension bracket is pivoted to the basket below the mouth of the basket and the detent means are arranged at a distance from the film hinge in particular close to the edge of the mouth.

Advantageous embodiments and arrangements of the detent means are indicated in claims 3 to 7.

One advantageous further development of the object described above which completely excludes contact in position of use with the deodorant present in the basket is disclosed in claim 8.

Another advantageous embodiment is set forth in claim 9 which preferably furthermore has the features disclosed in claims 10 to 12.

Claim 13 in this connection discloses a variant of the detent means which may be preferred under certain circumstances.

A development of a suspension bracket which, on the one hand, assures high reliability of retention of the position of the holder in its position of use and on the other hand, can be readily made at low manufacturing cost is disclosed in claim 14.

Other advantageous embodiments of the object described above are set forth in claims 15 to 18.

Illustrative embodiments of the invention are shown in the drawings and will be described in further detail below.

In the drawings:

FIG. 1 is a perspective view of a holder for toilet deodorants;

FIG. 2 shows a different embodiment, also in perspective;

FIG. 3 is a view thereof in cross section;

FIG. 4 shows a variant of details previously shown, seen in perspective;

Figure 5:
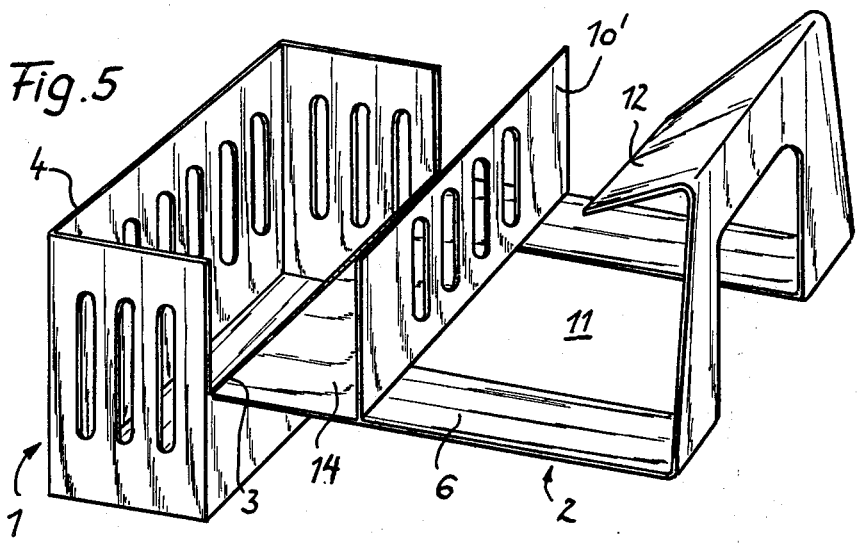
FIGS. 5, 6 and 8 to 10 are perspective showings of other embodiments.

All embodiments are characterized by an elongated basket 1 which is open on the top and a suspension bracket 2 for the removable attachment of the holder in correct position within a toilet bowl, the suspension bracket 2 gripping around the edge of the toilet bowl.

The basket and the suspension bracket 2 are made in a single piece of plastic by plastic shaping.

In FIGS. 1 to 3, the suspension bracket 2 is permanently attached to the basket 1 by means of a film hinge 3 the hinge axis of which extends parallel to the longitudinal length of the basket 1.

The film hinge 3 is furthermore formed, below the mouth 4 of the basket, on a lengthwise wall 5 of the basket 1.

In order to be able to manufacture the support in a mold which consists only of two parts, the suspension bracket 2 is arranged in such a manner that its articulated arm 6 extends at a right angle from the side wall 5, as can be noted from FIG. 1.

On the top of the bracket arm 6 there is developed a resilient detent 7 which, when the bracket arm 6 is placed in vertical position engages removably in an opening 8 arranged in the wall 5. Below the nose of the detent 7 there is arranged a hole 9 through which a stationary mold core extends.

The detent 8 could also be developed and arranged in such a manner that when the bracket arm 6 is put in vertical position it grips around the edge 4 of the opening.

On the bracket arm 6 there is furthermore developed a bridge 10 which when the suspension bracket is placed in vertical position partially closes the mouth of the basket 1, the said bridge extending at a right angle from the bracket arm 6 and its length corresponding approximately to the inside width of the basket 1.

Within the bracket arm 6 there is provided a cutout 7 which is arranged opposite the second bracket arm 12 of the suspension bracket 2.

The width and length of the bracket arm 12 is at most equal to the length and width of the cutout 11 so that the second bracket arm can also be made in a bipartite mold without movable mold cores being required.

In the embodiment shown in FIGS. 2 and 3, the detent 7 is so developed on the bridge 10 that when the suspension bracket 2 is placed in an erect position—as shown—the detent 7 grips around the edge 4 of the mouth.

Furthermore, in this case the lower part of the basket 1 is developed as a watertight tub 13.

The deodorant which is to be introduced into the basket 1 has the shape of a round bar whose length and diameter are smaller than the inside length and inside diameter respectively of the basket 1.

Deodorant dissolved in flush water can be collected in the tub 13.

Of course, the bar of deodorant may also be of square cross section.

FIG. 4 shows a variant of the detent means developed in the basket wall 5 and on the suspension bracket 2.

Figure 6:
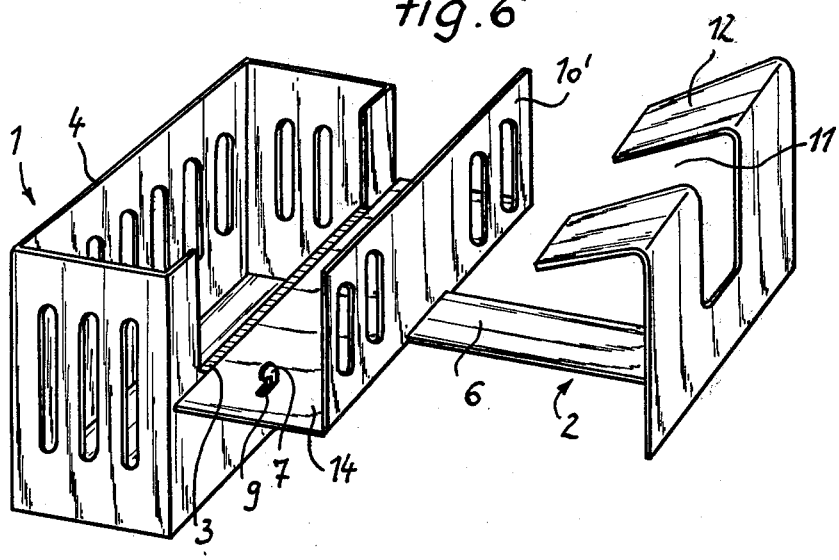

In the embodiments shown in FIGS. 5 and 6, a sidewall part 14 is articulated by means of a film hinge 3 which extends along the basket 1.

In this connection, the hinge is so arranged that it extends parallel to the mouth 4 of the basket during the molding and is so developed that the side wall part 14 can be swung upwards by 90°.

On the side wall part 14 there is formed a bridge 10' developed as a perforated cover, which when the side wall part 4 is swung up extends over the entire mouth of the basket 1.

The one arm 6 of a suspension bracket 2 is rigidly connected with the side wall part 14.

In this connection it is possible, as can be noted from FIGS. 5 and 6, to provide the cutout 11 either in the bracket arm 6 or in the bracket arm 12, in order in this case also to be able to form the suspension bracket 2 in the simplest possible manner on the side wall part 14.

Figure 7:
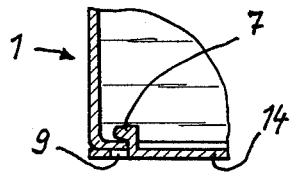
FIG. 7 is an enlarged view of details shown in FIG. 6, seen from above.

In order to secure the position of the side wall part 14, detents 7 are developed on the latter which detents, as can be noted from FIG. 7, detachably engage between fixed wall parts of the basket 1 when the side wall part 14 is in erected position.

Figure 8:
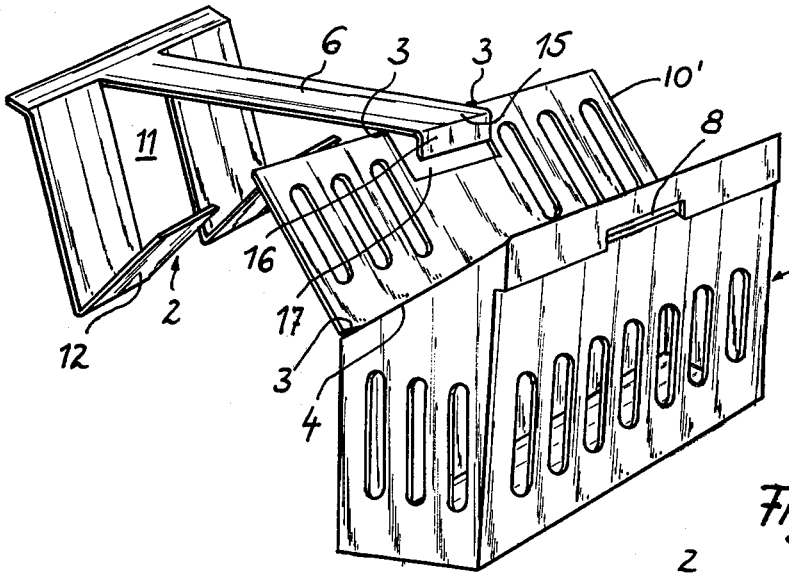
Figure 9:
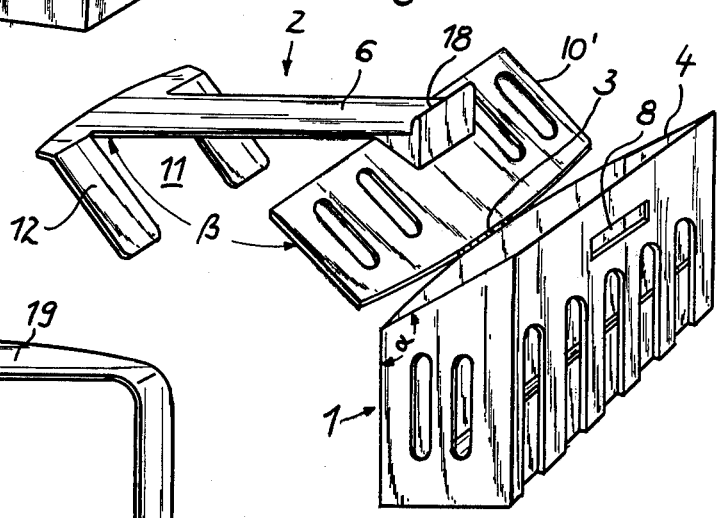
Figure 10:
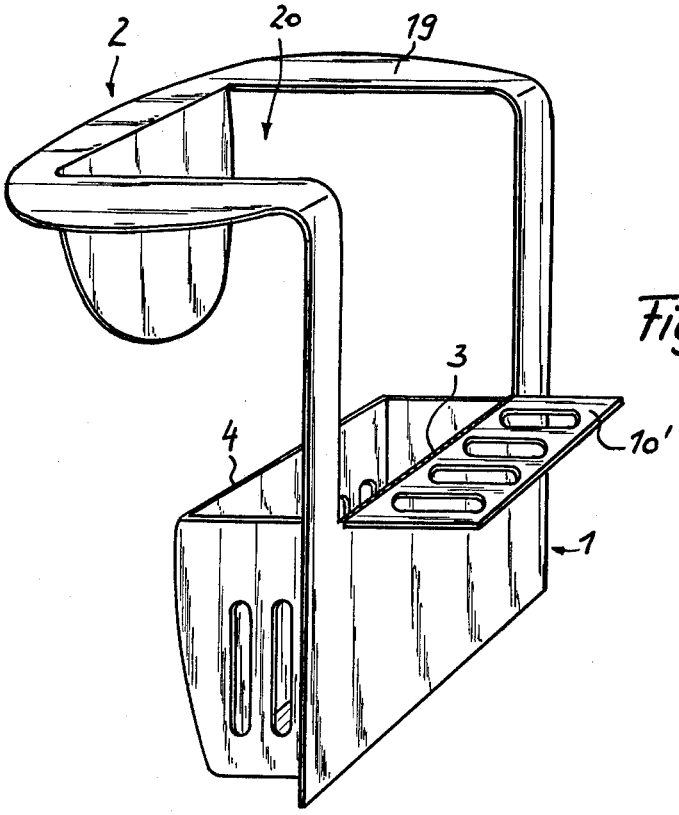

In the case of the holders shown in FIGS. 8 to 10, the bridge 10', which is developed as perforated cover, is pivoted by a film hinge 3 to a longitudinal wall of the basket 1, specifically to the edge 4 of the mouth. Furthermore, in this case the suspension bracket 2 is so arranged on the edge of the cover which is opposite the cover hinge that the suspension bracket 2 is in vertical position when the cover is closed.

For this purpose, in FIG. 8 the one arm 6 of the suspension bracket is pivoted by two film hinges to the bridge 10' which is developed as cover. Furthermore, a cantilever 15 is developed on the arm 6. The said cantilever has a detent nose 16 which is developed on it and which, when the bridge 10' is swung over so as to cover the basket 1, can be engaged from the outside into an opening 8 in the basket 1 so as on the one hand securely to hold the bridge 10' in the closed position and on the other hand securely to hold the suspension bracket 2 in the position of use.

In order that the cantilever 15 can also be easily produced in a mold consisting of only two parts, a cutout 17 of at least the same area is provided in the bridge 10' below the cantilever 15.

In the embodiment shown in FIG. 9, the mouth of the basket on the side wall of the basket to which the bridge 10' developed as cover is pivoted, is formed at an obtuse angle $\alpha$ of 135°.

The arm 6 of the cantilever 2 is rigidly connected with the bridge, the bridge 10' and the arm 6 forming an obtuse angle $\beta$ of also 135° so that when the bridge 10' is swung over against the mouth of the basket the arm 6 of the suspension bracket 2 is vertical and extends parallel to the long side walls of the box.

On the inner side of the bridge 10' there is developed a detent nose 18 which, when the bridge 10' is swung closed, engages into the mouth of the basket 1 and is held automatically and detachably in an opening 8.

FIG. 10 shows a support made in a single piece in which the approximately U-shaped suspension bracket 2 is rigidly connected with the basket 1. In the rib 19 of the suspension bracket 2 there is provided a cutout 20 which is opposite the mouth of the basket 1 and is so adapted in its shape and size to the inside cross section of the basket 1 that a mold core secured to the frame which corresponds to the inside of the basket 1 can be passed through the cutout 20.

On the basket 1 there is furthermore developed via a film hinge 3 a bridge 10' formed as cover, on the inside of which there are developed detent means (not shown) which can be developed, for instance, in the same manner as shown in FIGS. 6 and 7 so as to detachably secure the closed position of the bridge 10'.

What is claimed is:

1. Holder for toilet deodorants, comprising an elongated open basket for the replaceable receiving of a deodorant and a suspension bracket of plastic which is made structurally integral with the basket by plastic shaping and which engages over and beyond the mouth of the basket, characterized in that:

(a) one arm of the suspension bracket is permanently connected with the basket by a film hinge formed thereon;

(b) the hinge axis extends parallel to the lengthwise direction of the basket;

(c) the suspension bracket extends flexibly upwardly, from one long basket side and is shaped so that it can be placed into erect position for the use of the holder;

(d) detent means detachably securing the suspension bracket in vertical position and arranged corresponding to each other on the suspension bracket and the basket; and (e) a perpendicularly protruding bridge formed on the suspension bracket which, when the suspension bracket is in erect position, partially closes the mouth of the basket and secures the deodorant present in the basket from sliding out.

2. Holder according to claim 1, characterized in that the suspension bracket is articulated on the basket below the mouth of the basket and detent means are arranged in an arm at a distance from the film hinge and close to the edge of the mouth.

3. Holder according to claim 1, characterized in that the detent means has at least one detent nose which, when the bracket is in vertical position, can grip around the edge of the mouth of the basket and is formed on the suspension bracket.

4. Holder according to claim 1, characterized in that each detent means is shaped to fit into an opening in the basket.

5. Holder according to claim 1, characterized in that the detent means are arranged on the bridge and on the basket and cooperate with each other to detachably hold the suspension bracket firmly in vertical position.

6. Holder according to claim 1, characterized in that a detent nose which, when the bracket is in upright position, grips around the adjacent edge of the mouth of the basket and is formed on the bridge.

7. Holder according to claim 5, characterized in that the free end part of the bridge is formed to engage removably in an undercut or the like on the wall of the basket located opposite the film hinge.

8. Holder according to claim 5, characterized in that the bridge is shaped as a cover having openings and extends over the entire mouth of the basket.

9. Holder according to claim 1, characterized in that a side wall part of the basket is pivoted by means of a film hinge arranged below the mouth of the basket and is formed at least approximately parallel to the mouth of the basket, the suspension bracket being rigidly connected with said side wall part and arranged in parallelism therewith, and said side wall part being formed so that it can be placed in erect position, and detent means formed on the side wall part for detachably holding the side wall part firmly in the position of use.

10. Holder according to claim 9, characterized in that the pivoted side wall part extends over the entire length of said side of the basket.

11. Holder according to claim 9, characterized in that detents to secure the position of the side wall part are formed on said side wall part and are detachably engaged between fixed wall parts of the basket when the side wall is in erected position.

12. Holder according to claim 11, characterized in that on the side wall part pivoted to the basket there is a bridge extending upward from said side wall part and, in the position of use of the holder, partially closing the mouth of the basket.

13. Holder according to claim 12, characterized in that the detent means complementary to the basket are formed on the bridge which protrudes from the pivoted side wall.

14. Holder according to claim 9, characterized in that the suspension bracket is of approximately U-shape and has a cutout in at least one arm extending lengthwise of said arm while the other arm of the bracket is arranged opposite the cutout, the length and width of the second arm of the bracket corresponding at most to the length and width of the cutout.

15. Holder according to claim 5, characterized in that:

(a) the bridge which constitutes the cover is pivoted to a longitudinal edge of the mouth of the basket by means of a film hinge and is constructed to extend at an obtuse angle to the adjacent side wall of the basket;

(b) an arm of the suspension bracket is pivoted in the manner of a film hinge to that edge of the bridge opposite the cover hinge and is shaped to extend at an obtuse angle to the bridge;

(c) an arm of the suspension bracket which is pivoted to the bridge has a cantilever construction which protrudes in a direction towards the mouth of the basket beyond the bracket hinge, said protruding arm having at least one detent nose which corresponds to a detent arranged on the basket; and (d) a cutout which is at least equal in area to the projecting arm provided in the bridge opposite the projecting arm.

16. Holder according to claim 5, characterized in that:

(a) the mouth of the basket is arranged so that it inclines towards one longitudinal side;

(b) a bridge is pivoted by means of a film hinge to the lower lying longitudinal side of the mouth of the basket and is shaped to extend at an obtuse angle with respect to the adjacent side wall of the basket;

(c) an arm of an approximately U-shaped holding bracket is rigidly formed on the free edge of the bridge which faces away from the bridge hinge, the said bracket arm and the bridge forming with each other an obtuse angle $\beta$, said angle $\beta$ being equal to the angle $\alpha$ which is formed between the mouth side of the basket and the side wall of the basket to which the bridge is pivoted; and (d) on the bridge there is formed at least one detent nose which engages into the mouth of the basket and corresponds to an undercut on the basket.

17. Holder according to claim 16, characterized in that detent means which grip over the edge of the mouth of the basket are formed on the bridge.

18. Holder according to claim 1, characterized in that the detent and means defining an opening which cooperate with each other to detachably fasten the bridge in the closed position are disposed on the bridge and on the basket.

* * * * *